US008827132B2

(12) United States Patent
Mina et al.

(10) Patent No.: US 8,827,132 B2
(45) Date of Patent: Sep. 9, 2014

(54) FASTENER DRIVING TOOL AND WORKPIECE POSITIONING ATTACHMENTS

(75) Inventors: Nathan T. Mina, Lake in the Hills, IL (US); Michael P. Johnson, Round Lake, IL (US); Genaro O. Cortez, Jr., Bolingbrook, IL (US); Richard E. Pope, Woodstock, IL (US); Edward R. Brandt, Sycamore, IL (US)

(73) Assignee: Illinois Tool Works Inc., Glenview, IL (US)

( * ) Notice: Subject to any disclaimer, the term of this patent is extended or adjusted under 35 U.S.C. 154(b) by 369 days.

(21) Appl. No.: 12/428,274

(22) Filed: Apr. 22, 2009

(65) Prior Publication Data

US 2009/0266867 A1 Oct. 29, 2009

Related U.S. Application Data

(60) Provisional application No. 61/047,333, filed on Apr. 23, 2008.

(51) Int. Cl.
*B25C 7/00* (2006.01)

(52) U.S. Cl.
CPC ..... *B25C 7/00* (2013.01)
USPC ..... 227/148

(58) Field of Classification Search
USPC ..... 227/148, 8, 140, 147, 151, 119, 156
See application file for complete search history.

(56) References Cited

U.S. PATENT DOCUMENTS

| | | | | | |
|---|---|---|---|---|---|
| 2,774,969 | A * | 12/1956 | Samples | 227/147 |
| 3,360,176 | A * | 12/1967 | Gehl et al. | 227/148 |
| 3,542,273 | A * | 11/1970 | Hedrick | 227/130 |
| 4,662,227 | A * | 5/1987 | Peterson | 73/834 |
| 6,095,392 | A * | 8/2000 | Batts et al. | 227/8 |
| 6,098,865 | A * | 8/2000 | Tebo | 227/147 |
| 6,155,472 | A * | 12/2000 | Deziel | 227/8 |
| 6,213,373 | B1 * | 4/2001 | Wakai | 227/147 |
| 6,264,211 | B1 * | 7/2001 | Granado | 279/143 |
| 6,481,613 | B1 * | 11/2002 | Tebo | 227/147 |
| 6,631,836 | B2 * | 10/2003 | Dickhaut | 227/148 |
| 6,755,597 | B2 * | 6/2004 | Bergner et al. | 409/178 |
| 6,843,402 | B2 * | 1/2005 | Sims et al. | 227/148 |
| 7,255,256 | B2 * | 8/2007 | McGee et al. | 227/8 |
| 7,341,172 | B2 * | 3/2008 | Moore et al. | 227/8 |
| 7,565,992 | B2 * | 7/2009 | Buetow | 227/110 |
| 7,677,425 | B2 * | 3/2010 | Brendel et al. | 227/8 |
| 7,721,817 | B2 * | 5/2010 | McGee et al. | 173/37 |
| 7,882,994 | B2 * | 2/2011 | Francescon | 227/148 |
| 2001/0038026 | A1 * | 11/2001 | Dickhaut | 227/148 |
| 2002/0062551 | A1 * | 5/2002 | Jacoby | 29/798 |

(Continued)

FOREIGN PATENT DOCUMENTS

WO WO 2007082136 A2 * 7/2007

*Primary Examiner* — Robert Long
(74) *Attorney, Agent, or Firm* — Levenfeld Pearlstein, LLC

(57) ABSTRACT

Attachments for a fastening tool are configured to position the fastening tool raceway for driving a fastener from the tool into a workpiece at a desired location. The attachments include work contact elements including a pair of surfaces for contact with two surfaces of the workpiece to properly position the tool raceway.

3 Claims, 8 Drawing Sheets

(56) References Cited

U.S. PATENT DOCUMENTS

| | | | | |
|---|---|---|---|---|
| 2003/0024962 | A1* | 2/2003 | Sims et al. | 227/148 |
| 2004/0011845 | A1* | 1/2004 | Walter | 227/120 |
| 2005/0145670 | A1* | 7/2005 | Huang | 227/148 |
| 2006/0196682 | A1* | 9/2006 | McGee et al. | 173/1 |
| 2008/0245840 | A1* | 10/2008 | Beauclair et al. | 227/148 |
| 2008/0296341 | A1* | 12/2008 | Francescon | 227/119 |
| 2010/0213237 | A1* | 8/2010 | Tebo | 227/148 |
| 2010/0308098 | A1* | 12/2010 | Francis et al. | 227/148 |

* cited by examiner

FASTENER DRIVING TOOL AND WORKPIECE POSITIONING ATTACHMENTS

CROSS-REFERENCE TO RELATED APPLICATION DATA

This application claims priority to Provisional U.S. Patent Application Ser. No. 61/047,333, filed Apr. 23, 2008.

BACKGROUND OF THE INVENTION

The present invention relates generally to fastener driving tools, and more particularly to a fastener driving tool and attachments to properly position the tool on the workpiece.

Fasteners such as staples are well known in the art and are widely used for numerous fastening applications. In one such application, fasteners are used to fasten various parts of casegoods, such as cabinets, to one another during the manufacturing or assembly process.

The staples are typically driven by a powered tool, such as a pneumatic tool, into certain, specific joints of the cabinet. For example, staples are driven into the face frame-to-side joint, the back-to-side joint, and the top-to-back and bottom-to-back nailer boards. In cabinets with flush mounted backs (the back and sides are flush), staples are also driven into the back.

One issue with cabinet fabrication is that there is no room for mistakes. Fastener depth and placement must be quite precise otherwise a fastener can exit through a panel that is visible or that should not have any such penetrated fasteners. This is referred to as blowout, which must be avoided.

One way in which to avoid blowout is by using attachments to properly position the nosepiece such that the fastener enters the cabinet side/top/bottom/back in a desired location sufficiently thick to accommodate the fastener. While some attachments have been used, they are typically shop fabricated, one of a kind, attachments made for personal use.

Moreover, many of these home-made attachments do not necessarily provide the flexibility, usability and accuracy needed to assure good fastener penetration with no blowout.

Accordingly, there is a need for a fastener driving tool with workpiece attachments for accurate and repeatable installation of fasteners at workpiece joints without the potential for fastener blowout.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying photographs, wherein.

DETAILED DESCRIPTION OF THE INVENTION

Figure 1:
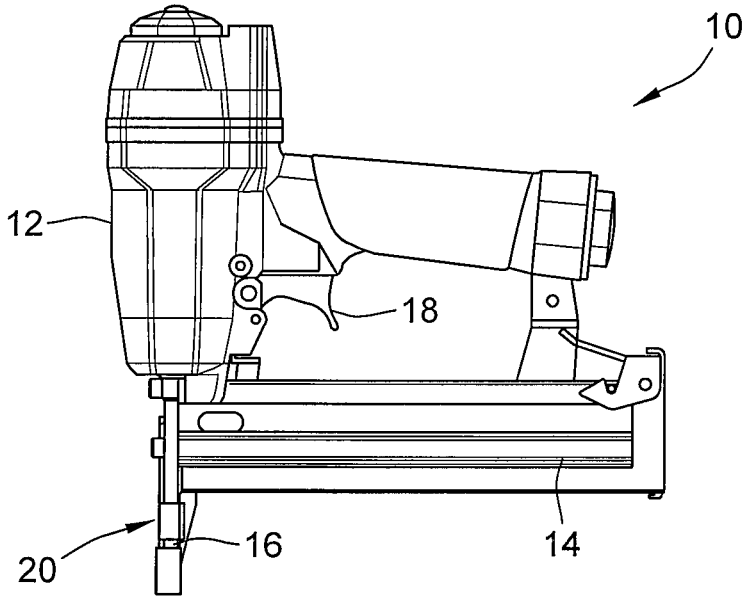
FIG. 1 is a side view illustrating a face frame to side attachment with a work contact element attachment.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention," relates to a requirement of the United States Patent Office, and does not imply, nor should be inferred to limit the subject matter disclosed herein.

Referring now to the figures, and in particular to FIGS. 1-7, there is shown a pneumatic fastener driving tool 10 (also referred to as "fastening tool" and "tool") with two embodiments of a front to side guide attachment of the present invention. The tool can be, for example, any of the SURE-SHOT™ fastener tools, available from ITW Industrial Fastening of Elgin, Ill. The fastening tool is a straight firing tool (the fastener magazine is at an angle $\alpha$ of 90 degrees to the direction at which the fastener is driven from the fastening tool 10). For purposes of the present disclosure various attachments will be illustrated on a single type of fastening tool 10.

Referring first to FIG. 1, a typical fastening tool 10 includes, generally, a housing 12, a magazine 14 in which the collated fasteners are held and fed to a driver blade (not shown). The driver blade (which in the present tool is a pneumatic element) reciprocates to drive the fastener from the collation through a raceway 16, into the workpiece or in the present example, a cabinet C (for purposes of the present disclosure, workpiece and cabinet are used interchangeably). A trigger 18 is depressed to actuate the pneumatic system to drive the fastener. It will be appreciated that the raceway 16 is at a height above the workpiece C so that it does not contact (and thus possibly mar) the workpiece C, but is sufficiently close to the workpiece C so that the fastener is directed to the workpiece C to assure proper penetration.

Figure 2:
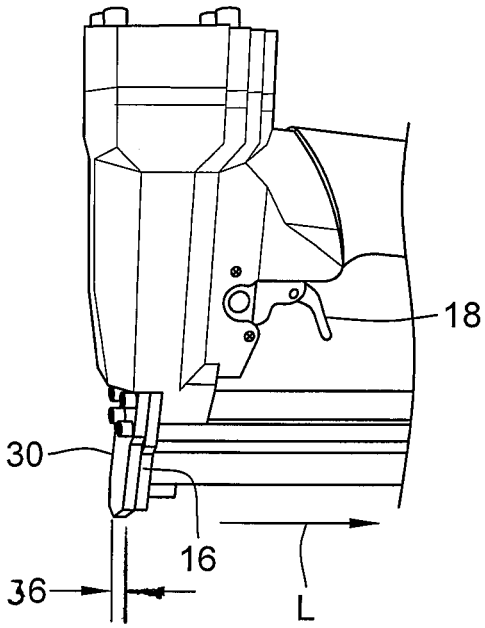
FIG. 2 is a front perspective view of the fastening tool with a fixed attachment.
Figure 3:
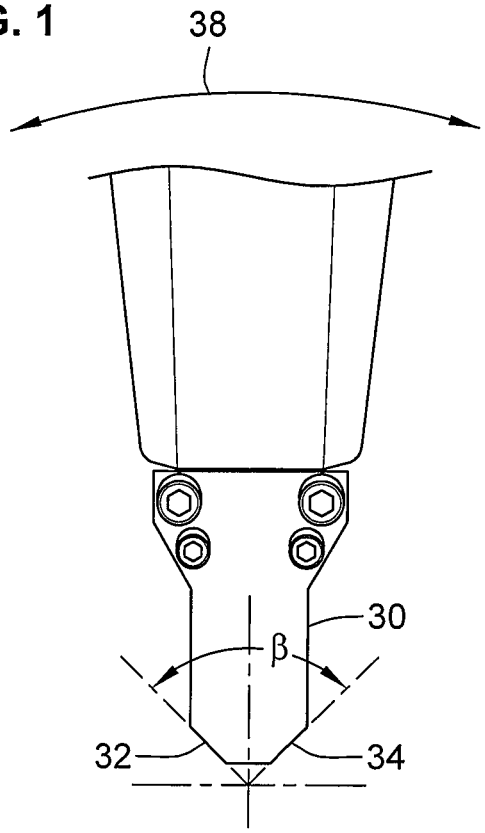
FIG. 3 is a front view of the tool and attachment of FIG. 2.
Figure 4:
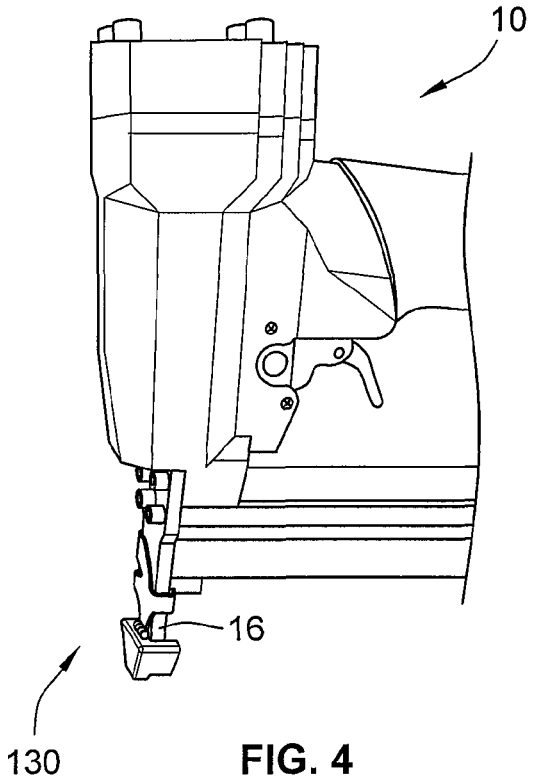
FIG. 4 is a front perspective view of a fastening tool with the face frame to side attachment of FIG. 1.
Figure 5:
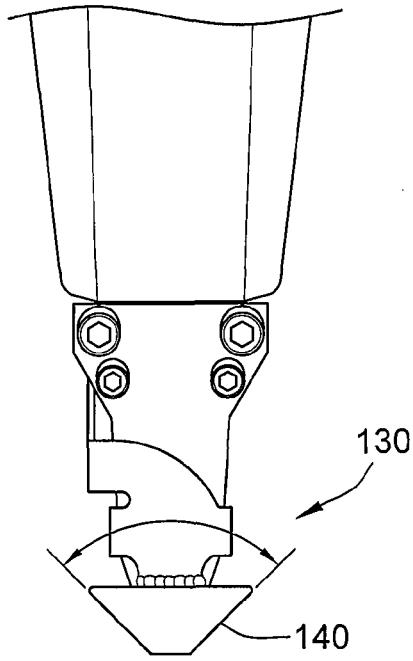
FIG. 5 is a front view of the tool and attachment of FIG. 4.
Figure 6:
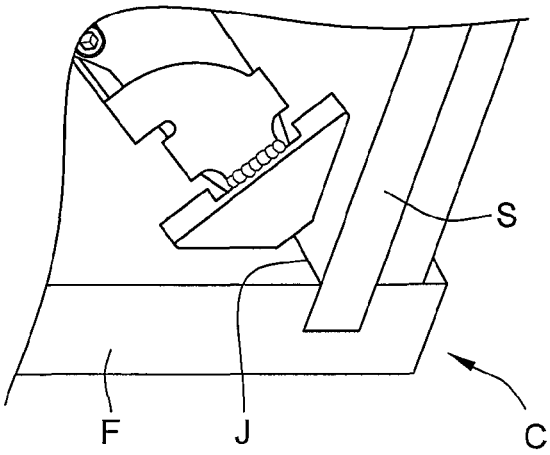
FIG. 6 illustrates the tool and attachment of FIGS. 4 and 5, as seen from the front, in position between the face frame (F) and side (S) of an exemplary cabinet.
Figure 7:
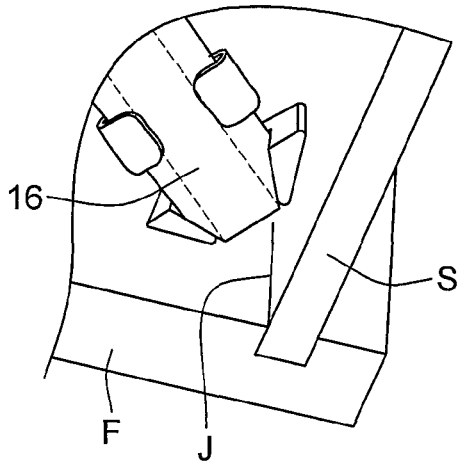
FIG. 7 is a rear illustration of the tool and attachment of FIG. 6.

In FIGS. 2 and 3 there is shown a first face frame to side attachment 30 that is a fixed, static element mounted to the front or nosepiece 20 of the fastening tool 10. The attachment 30 has angled surfaces 32, 34 that define a 90 degree angle to rest on the face frame (F) and side (S) surfaces of the cabinet C. The attachment 30 has a depth (as indicated at 36 in FIG. 3) so that the tool 10 will not rock back and forth (as indicated by the arrow at 38) and is held steady both across the face of the tool 10 and along the length (L in FIG. 2) of the tool 10. This assures that the fastening tool 10 is in the proper position and at the proper angle (front to back), when actuated, for placement and penetration of the fastener. It will be appreciated that in this configuration, the attachment 30 does not use an actuated work contact element to unlock or engage the trigger mechanism and as such, a dual trigger 18 system may be employed (the dual trigger is not illustrated).

While the faces 32, 34 of the attachment 30 are shown at 90 degrees (each at 45 degrees from the horizontal and the vertical), the attachment 30 can be configured with any angle β necessary for a particular cabinet C design.

In FIGS. 1 and 4-7 a face frame to side attachment 130 is shown that includes an actuated work contact element 140. The work contact element 140 is a biased (spring mounted) reciprocating element that, when depressed, allows for engagement of the fastening tool trigger 18. When the element is not depressed, the trigger 18 is "locked out" from actuating the pneumatic cycle. The lock-out feature will be recognized by those skilled in the art. The remaining features of the attachment 130 with the actuated work contact element 140 are the same as those for the non-actuated element attachment 30.

It will be appreciated by those skilled in the art that in this type of configuration the fasteners are driven perpendicular to the joint J and the fastening tool 10 and movement of the tool 10 along the cabinet C is perpendicular to the joint J.

Figure 8:
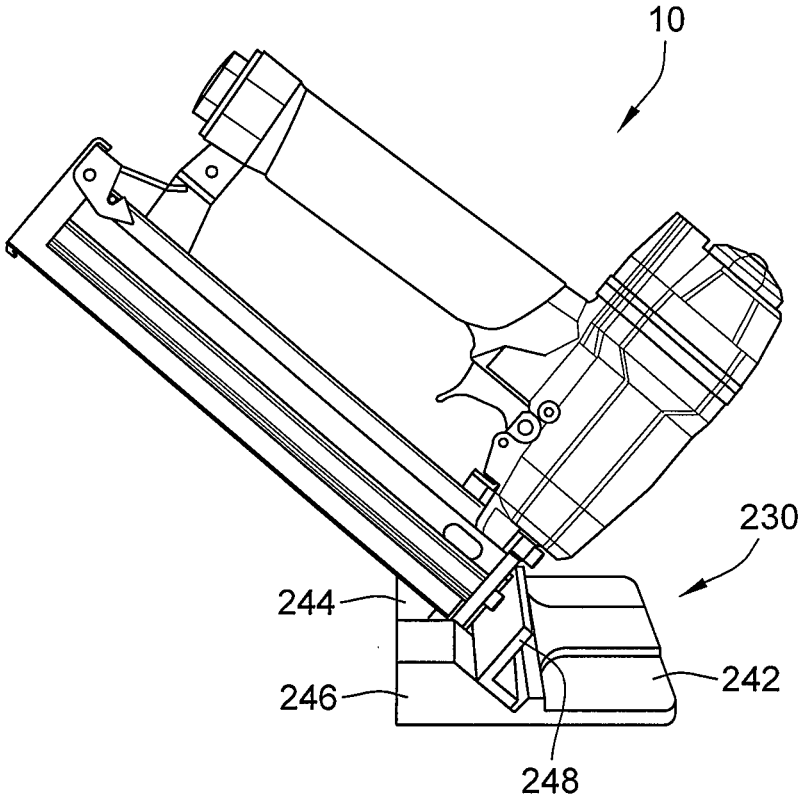
FIG. 8 is a perspective illustration of a tool with a back to side attachment.
Figure 9:
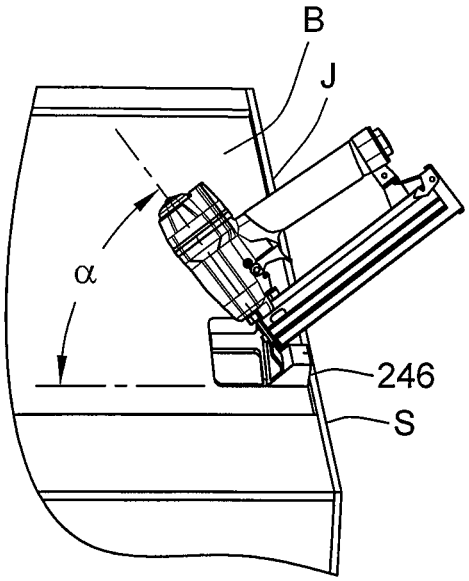
FIG. 9 is another perspective illustration of the tool of FIG. 8 in position between the back (B) and side (S) of an exemplary cabinet.
Figure 10:
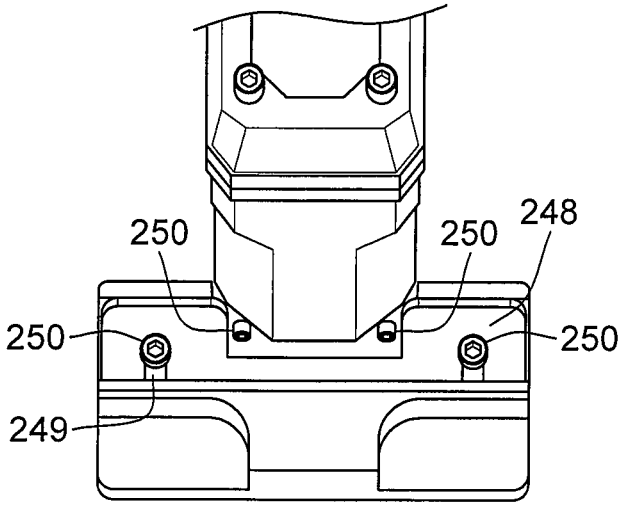
FIG. 10 is a front view of the tool attachment.

Referring now to FIGS. 8-10 there is shown a tool 10 with a back (B) to side (S) attachment 230. The attachment 230 has an enlarged foot 242 that allows a user to keep a hand on the foot 242 to slide the tool 10 along the surface of the workpiece C so that fasteners can be driven as desired (e.g., at a desired spacing). The attachment 230 can be configured for mounting to the tool 10 so that the fasteners are driven at a desired angle to the back B or side S. The foot 242 includes a stop wall 246 that abuts the side S of the cabinet C to position the tool 10 (the raceway 16) at the joint J. An angled (L-shaped) bracket 248 mounts the tool 10 to the foot 242. As seen in FIG. 10, fasteners (bolts or cap screws 250) secure the bracket 248 (through slotted openings 249) to the tool 10 and permit for adjusting the tool 10 and foot 242 relative to one another. It will be appreciated that the attachment 230 can be made as in a single piece (a unitary element), which although not shown, is within the scope of the present invention.

In a present attachment 230, the angles are 45 degrees and 60 degrees (see, e.g., FIG. 9). In contrast to the fastening tool 10 and attachments 30, 130 of FIGS. 1-7, this tool 10 and attachment 230 allows for driving fasteners parallel to the joint J and the tool 10 and movement of the tool 10 along the workpiece or cabinet C is with the raceway 16 parallel to the joint J. It will be appreciated that it is the spacing between the raceway 16 and the end 244 of the foot 242 that properly positions the fastener as it exits the raceway 16.

Figure 11:
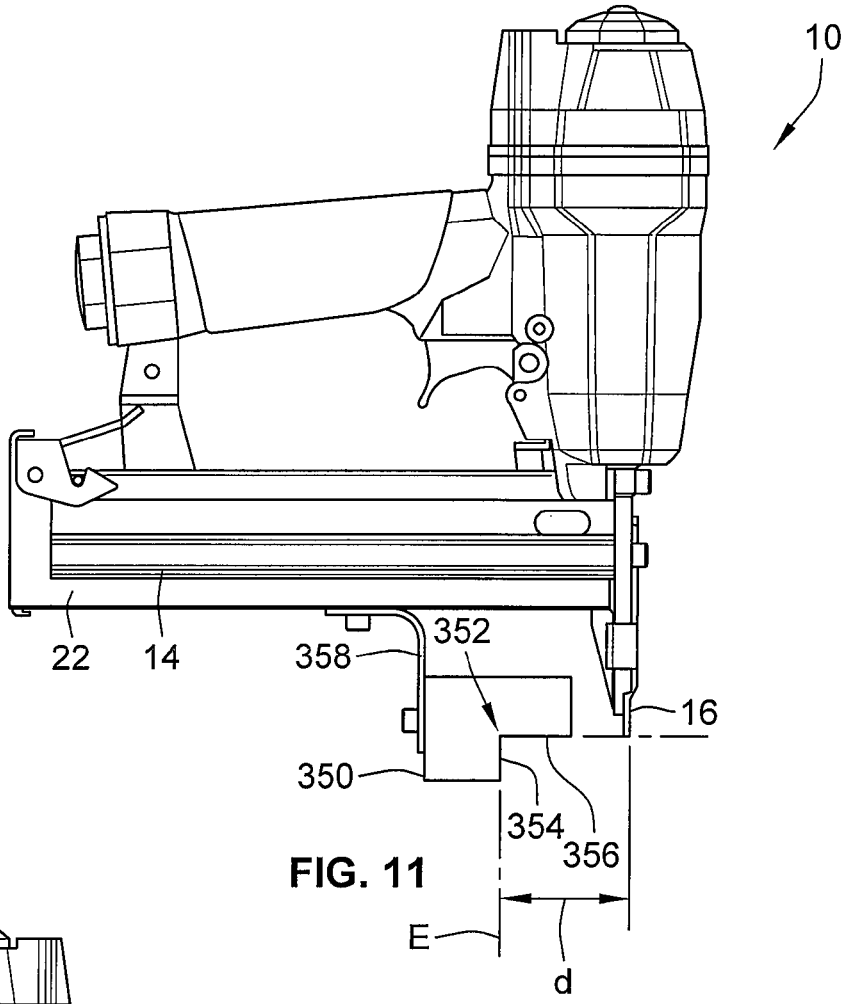
FIG. 11 is a side view of a tool with a one position adjustable linear top (or bottom) to back attachment.
Figure 12:
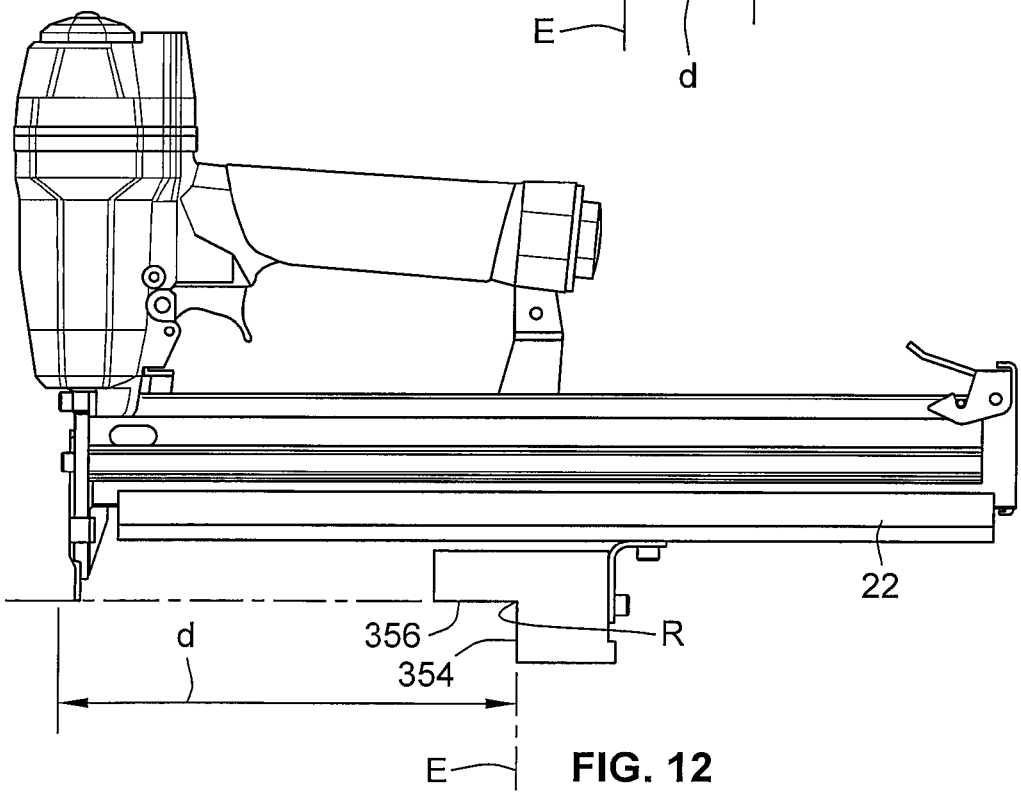
FIG. 12 is side view of a tool with an adjustable linear top (or bottom) to back attachment.
Figure 12A:
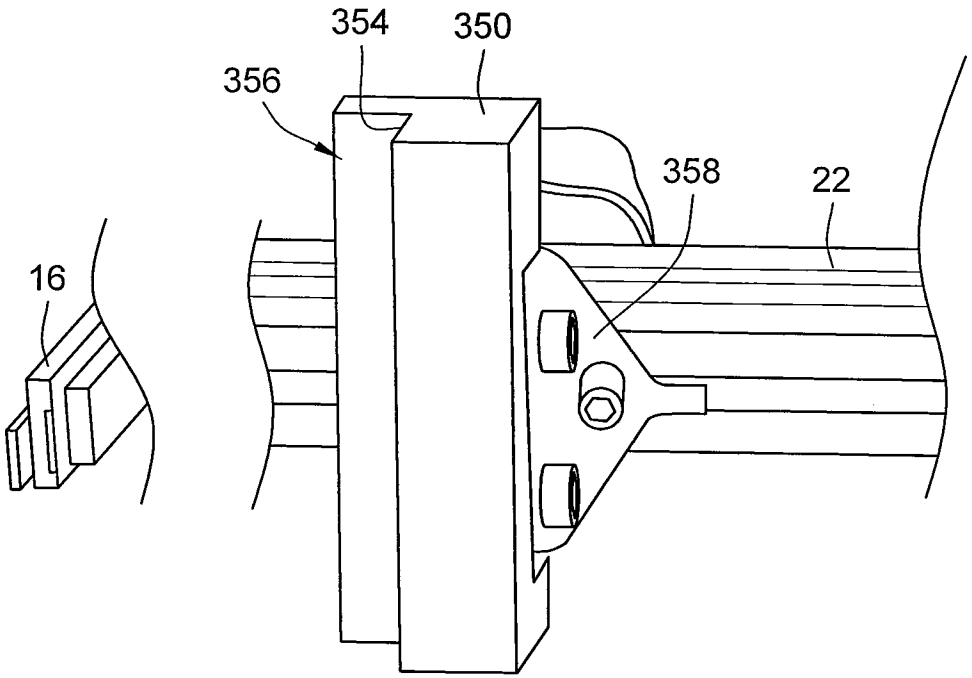
FIG. 12A is a partial bottom view of the adjustment rail for the adjustable linear top or bottom to back attachment of FIG. 12.
Figure 13:
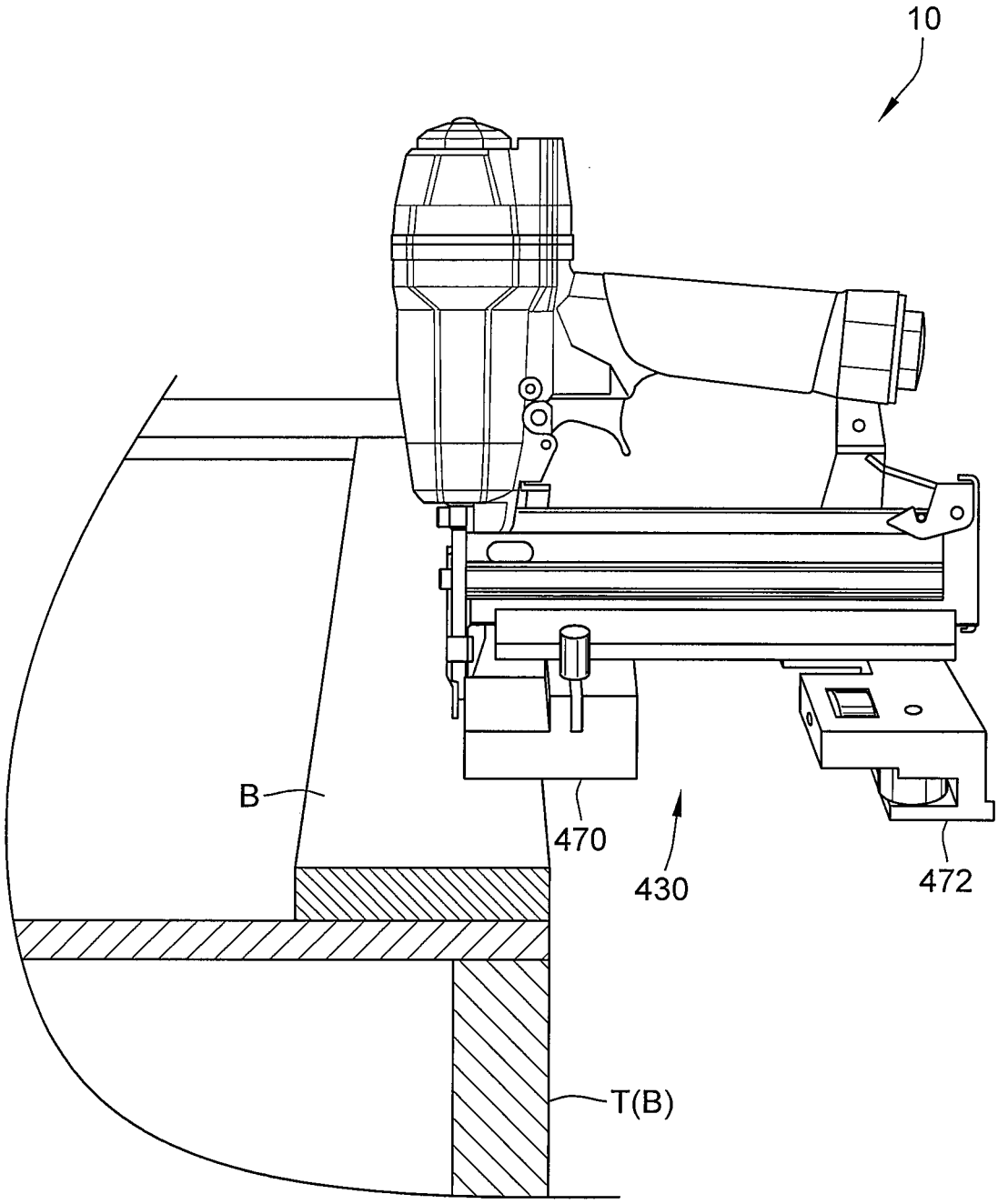
FIG. 13 is a perspective illustration of a tool with a two position adjustable linear top (or bottom) to back attachment shown in a near-edge fastening position.
Figure 14:
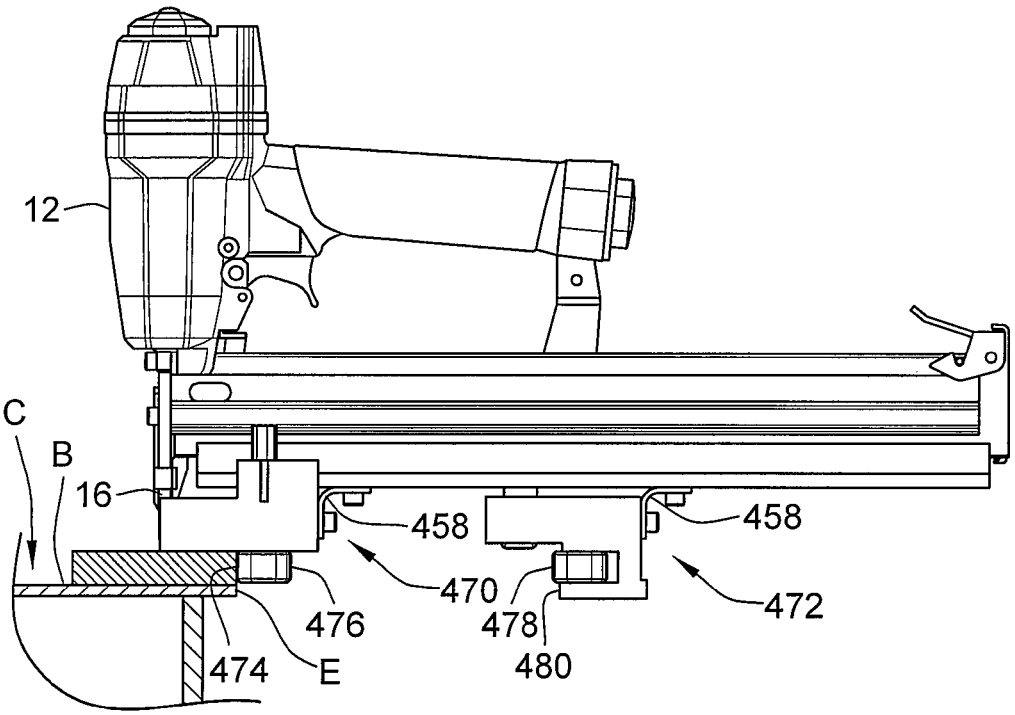
FIG. 14 is a side view of the tool of FIG. 13 in position between the back (B) and side (S) of an exemplary cabinet.
Figure 15:
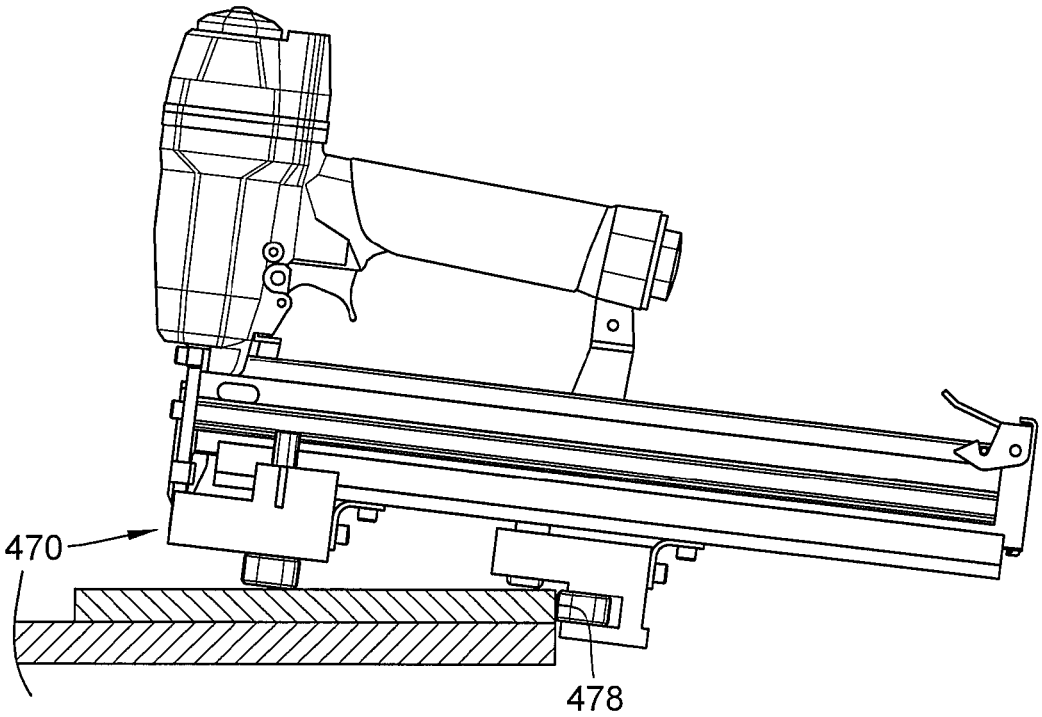
FIG. 15 is a side view of the tool of FIGS. 13 and 14 moving into position for spaced from the edge fastening, with the spring-mounted rollers resting on the workpiece, prior to urging the tool into the fastening position.
Figure 16:
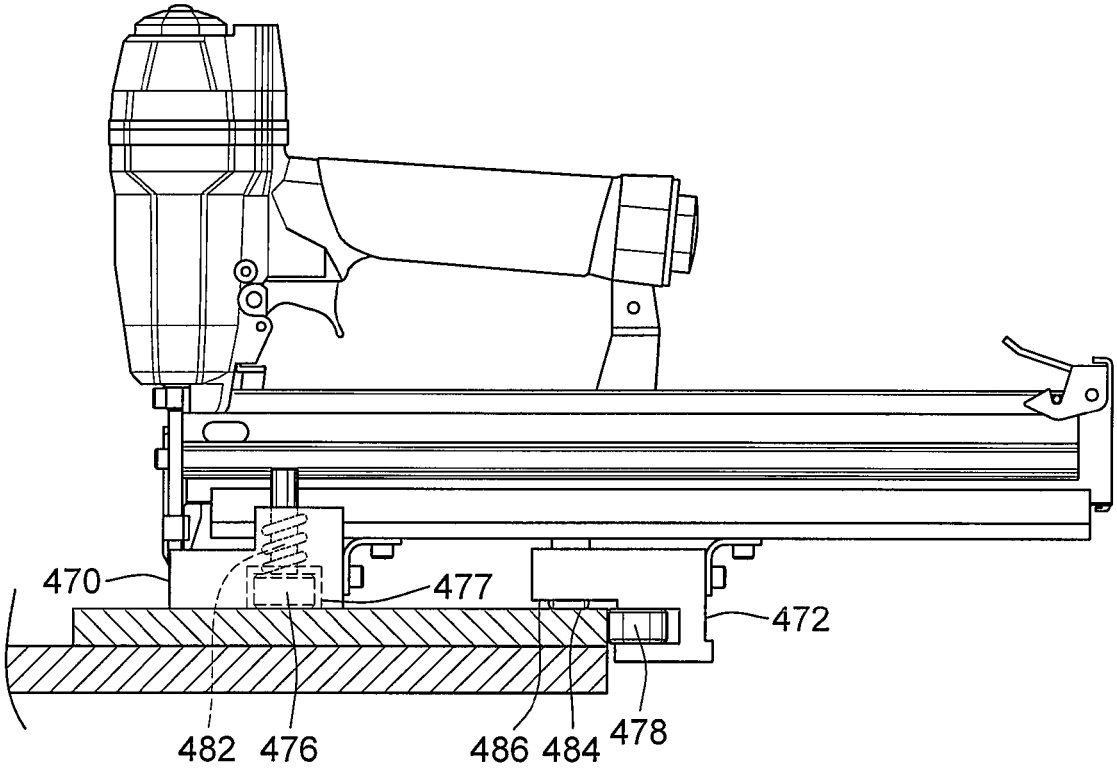
FIG. 16 is a side view of the tool of FIG. 15 in position for fastening, with the attachment engaging the workpiece for center or spaced-from-the-edge fastening.
Figure 17:
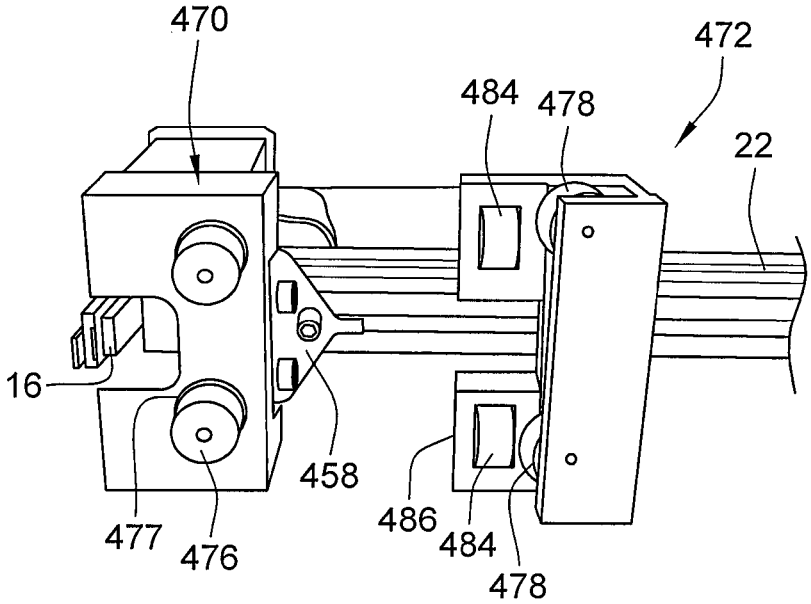
FIG. 17 is a bottom view of the tool attachment of FIGS. 13-16.

Referring now to FIGS. 11-12A there is shown a tool 10 with a one position adjustable linear top T (or bottom M) to back B attachment 330. The tool 10 includes a channel 22 or like mounting member affixed to a bottom of the tool 10. The channel 22 serves as a track that is engaged by an adjusting block 350 and provides a full range of adjustment so that the depth or distance d that the fastener is driven from the edge E of the workpiece C can be adjusted to a desired depth or distance.

The adjusting block 350 can be formed having a notch 352 therein that defines a surface for resting along (or engaging) a side S of the cabinet C (a side engaging surface 354) and a surface for resting on (or engaging) a flush back or nailer of the cabinet (back/nailer-engaging surface 356). The tool 10 is positioned with the notch 352 on a corner R (at the side and back) of the cabinet C to properly position the tool 10 for fastener penetration. Different lengths of channel 22 can be provided to permit for deeper (farther from edge) fastening as desired. The block 350 can include a mount 358 that is secured to the track or channel 22 anywhere along the length of the track 22 to provide the desired depth of fastening. Alternatively, although not shown, the mount 358 can be directly (fixedly) attached to the magazine 14 (that is, without the use of the channel) by, for example, welding or the like. This provides a fixed distance edge fastening attachment.

Referring now to FIGS. 13-17 there is shown a fastening tool 10 with a two position adjustable linear top (or bottom) to back attachment 430. The attachment 430 includes a forward position (or near-to-edge/shallow placement) element 470 and rearward position (or spaced-from-edge/deep placement) element 472. The forward position element 470 includes a stop wall 474 that is formed by a pair of rollers or wheels 476 that engage the edge E (e.g., side, bottom or top) of the cabinet C and from which the depth of the fastener is determined. The rollers 476 permit readily sliding the fastening tool 10 (with the attachment 430 resting on the cabinet edge E) along the cabinet C to more efficiently carry out the fastening operation.

As can also be seen in FIGS. 13-17, the attachment 430 includes a rearward position element 472 that permits fasteners to be placed at a deeper location on the back B of the cabinet C, for example in toward the middle of the cabinet, to for example, fasten support rails or the like at the interior of the cabinet back. In addition, in certain constructions, the back of the cabinet is recessed with the sides and the difference accommodated by the nailer. Often, it is desirable to place fasteners through the nailer into the back to fasten the layers to one another. As such, there is a need to install fasteners away from the edge.

Nevertheless, the depth of the deeper or rearward positioned fasteners must also be at a desired location (as opposed to at a random distance from the edge E). The second position element 472 provides such a guide. The second position element 472 includes rollers 478 set into a side surface 480 (that engage the workpiece edge E) to facilitate movement of the tool 10 and attachment 430 along the workpiece C.

In order to permit proper contact of the fastening tool head 12 (at the raceway 16) with the cabinet C, the forward element rollers 476 are mounted to the element 470 by springs 482 or other biasing elements. This permits the forward rollers 476 to be urged in to recessed 477 (to be recessed, see, e.g., FIGS. 15 and 16) so that the rearward element 472 can be properly positioned, that is, so that the rearward element 472 lies flush on the workpiece C, and the fastening tool head 12 is brought into proper position for fastener penetration. It will be appreciated that the depth of the forward and rearward elements 470, 472 can be adjusted by moving the elements 470, 472 (by their mounts 458) along the channel 22 mounted to the bottom of the fastening tool 10. The elements 470, 472 can be moved independently along the channel 22.

In the present two-position attachment 430, the rearward element 472 can include bottom rollers 484 or bearing surfaces, such as pads (formed from a low-friction material) located on a bottom-inner surface 486 adjacent to, but at 90 degrees to the edge rollers 478. This configuration provides a non-marring contact surface to ride along the cabinet back B so that when the rearward element 472 is used and the edge 478 and bottom rollers 484 (or pads) provide a vehicle for smoothly moving the rearward element 472 along the cabinet C.

In a present embodiment, the forward and rearward elements 470, 472 are formed from a low-friction polymeric material, preferably non-marring, to prevent inadvertently damaging any of the surfaces of the cabinet C. Other materials can be used, which, if appropriate, can be covered or coated with a non-marring material. It will be appreciated that the various attachments 30-430 are anticipated to permit readily moving the tool 10 along the cabinet C surfaces and to readily position the tool on the cabinet C at the joints J as desired. The attachments 30-430 permit sliding the tool 10 (and attachments) along the surfaces without marring or otherwise damaging the surfaces, thus improving the speed, efficiency and precision of placing fasteners into the various locations of the cabinet C.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An attachment for use with an associated fastening tool for driving a fastener into a workpiece at a juncture of two surfaces of the workpiece at an angle to one another, the fastener being driven into the juncture, at a desired location along the juncture, the associated fastening tool having a raceway through which the fastener is driven into the workpiece, the attachment comprising:

a work contact element formed as a foot having a pair of surfaces at 90 degrees to one another for contact with the two surfaces of the workpiece forming the juncture, the foot having an opening therein through which the fastener is driven, the foot further having a mounting surface sloped relative to the pair of surfaces, and the work contact element further including a mount for adjustably mounting the fastener driving tool thereto at an angle between, but exclusive of 0 degrees and 90 degrees relative to the surfaces, wherein the mount includes a first side surface abutting the mounting surface and a second side surface angled relative to the first side surface, the second side surface configured for adjustable mounting to the fastening tool so as to be adjustable along the fastening tool to vary the distance between the fastener driving tool and the juncture of the two surfaces of the workpiece to vary the depth of penetration of the fastener, into the juncture of the two surfaces of the workpiece.

2. The attachment in accordance with claim 1 wherein the work contact element has a mounting surface for mounting the mount, the mounting surface being perpendicular to the driving direction of the fastener.

3. The attachment in accordance with claim 1 wherein the attachment is made as a multi-piece member.

* * * * *